US010233879B2

(12) United States Patent
Kawazumi et al.

(10) Patent No.: US 10,233,879 B2
(45) Date of Patent: Mar. 19, 2019

(54) STRUCTURE FOR MOUNTING RESONATORS TO DUCT

(71) Applicant: HONDA MOTOR CO., LTD., Tokyo (JP)

(72) Inventors: Takeji Kawazumi, Wako (JP); Fuyuki Hosokawa, Wako (JP); Yoji Fukui, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 211 days.

(21) Appl. No.: 15/459,238

(22) Filed: Mar. 15, 2017

(65) Prior Publication Data

US 2017/0284349 A1 Oct. 5, 2017

(30) Foreign Application Priority Data

Mar. 31, 2016 (JP) ..... 2016-071490

(51) Int. Cl.
*F02M 35/12* (2006.01)
*G10K 11/04* (2006.01)

(52) U.S. Cl.
CPC ..... *F02M 35/1255* (2013.01); *G10K 11/04* (2013.01)

(58) Field of Classification Search
CPC ..... F02M 35/1255; G10K 11/04
USPC ..... 181/224, 229, 241
See application file for complete search history.

(56) References Cited

U.S. PATENT DOCUMENTS 4,984,350 A * 1/1991 Hayashi ..... B60R 19/48 180/68.3
6,267,092 B1 * 7/2001 Matsumoto ..... F02F 7/006 123/184.57
7,614,380 B2 * 11/2009 Tsutsui ..... F02M 35/10295 123/184.57
7,793,757 B2 * 9/2010 Letourneau ..... F02M 35/1261 181/229

FOREIGN PATENT DOCUMENTS

JP 2513993 Y2 10/1996
JP 2017114376 A * 6/2017 ..... B62M 7/04

* cited by examiner

*Primary Examiner* — Jeremy A Luks
(74) *Attorney, Agent, or Firm* — Birch, Stewart, Kolasch & Birch, LLP

(57) ABSTRACT

In a structure for mounting resonators to a duct, the duct including openings is provided with a plurality of duct-side mounting pieces, and the resonators formed separately from the duct and including communication ports coupled to the openings are provided with a plurality of resonator-side mounting pieces that are mounted to the duct-side mounting pieces. Coupling portions of the duct and the resonators are configured to ensure turning the resonators when the resonators are mounted to the duct. On the plurality of duct-side mounting pieces disposed with intervals in a peripheral direction of the coupling portions, mounting surfaces are formed to be opposed to turning directions of the resonators when mounting the resonators to the duct, the resonator-side mounting pieces being abutted against and mounted to the mounting surfaces. Accordingly, it is possible to turn the resonators when mounting them to the duct and improve attachment work.

10 Claims, 4 Drawing Sheets

STRUCTURE FOR MOUNTING RESONATORS TO DUCT

BACKGROUND OF THE INVENTION

Field of the Invention

The present invention relates to a structure for mounting resonators to a duct, in which the duct that forms a flow passage for air is provided with openings and a plurality of duct-side mounting pieces, and the resonators are provided with a plurality of resonator-side mounting pieces that are mounted to the duct-side mounting pieces, the resonators including communication ports coupled to the openings and being formed separately from the duct.

Description of the Related Art

There has been known the following mounting structure of Japanese Utility Model Registration No. 2513993. To mount a resonator separate from an intake duct to the intake duct that guides external air to an internal combustion engine mounted to a vehicle, the mounting structure is configured such that mounting pieces of the intake duct and mounting pieces of the resonator are fastened to each other.

Meanwhile, to hold air tightness, an annular sealing member or the like is generally disposed on a coupling portion of the duct and the resonator separate from the duct. For fitting with this sealing member, the resonator needs to be screwed into the duct while being turned. In this case, the screwing work needs to be performed while a mutual interference between the plurality of mounting pieces is avoided, possibly causing deterioration of attachment workability.

SUMMARY OF THE INVENTION

The present invention has been achieved in view of the above-mentioned circumstances, and it is an object thereof to provide a structure for mounting resonators to a duct that allows the resonators to turn when the resonators are mounted to the duct and also ensures an improvement in attachment work.

In order to achieve the object, according to a first feature of the present invention, there is provided a structure for mounting resonators to a duct, in which the duct that forms a flow passage for air is provided with openings and a plurality of duct-side mounting pieces, and the resonators are provided with a plurality of resonator-side mounting pieces that are mounted to the duct-side mounting pieces, the resonators including communication ports coupled to the openings and being formed separately from the duct, wherein coupling portions of the duct and the resonators are configured to ensure turning the resonators when the resonators are mounted to the duct, and the plurality of duct-side mounting pieces are disposed with intervals in a peripheral direction of the coupling portions, and the plurality of duct-side mounting pieces include mounting surfaces, the mounting surfaces being formed to be opposed to turning directions of the resonators when mounting the resonators to the duct, the resonator-side mounting pieces being abutted against and mounted to the mounting surfaces.

With the first feature of the present invention, when the resonators are turned to mount the resonators to the duct, the mounting surfaces opposed to the turning directions of the resonators are formed on the duct-side mounting pieces. Accordingly, when the resonators are screwed into the duct while being turned so as to be mounted to the duct, the resonators are easily turned in a range where the resonator-side mounting pieces do not interfere with the duct-side mounting pieces, ensuring enhancing attachability.

According to a second feature of the present invention, in addition to the first feature, a pair of the duct-side mounting pieces are disposed on the duct so as to be respectively positioned on opposite sides of each of the coupling portions on a projection view to a plane perpendicular to turning centers of the resonators when the resonators are mounted to the duct.

With the second feature of the present invention, the pair of duct-side mounting pieces are respectively disposed on the opposite sides of the coupling portions on the projection view to the plane perpendicular to the turning centers of the resonators. This allows the resonators to be turned at an angle close to 180 degrees when the resonators are mounted, thereby ensuring further improvement of the attachablily at the maximum turning range.

According to a third feature of the present invention, in addition to the second feature, a plurality of the resonators are mounted parallel to the duct, the resonators adjacently paired in a parallel direction each including one pair of the resonator-side mounting pieces, a pair of the resonator-side mounting pieces disposed closer to each other, among the resonator-side mounting pieces, being mounted in common to a specific duct-side mounting piece that is disposed between the resonators adjacently paired among the plurality of duct-side mounting pieces of the duct.

With the third feature of the present invention, the pair of resonator-side mounting pieces disposed on closer to each other in the resonators adjacently paired in the parallel direction are mounted in common to the specific duct-side mounting piece that is provided on the duct so as to be disposed between the adjacently paired resonators. This reduces the number of duct-side mounting pieces of the duct, ensuring reduction in an interval between the resonators adjacent to each other.

According to a fourth feature of the present invention, in addition to the third feature, the pair of resonator-side mounting pieces corresponding to the specific duct-side mounting piece are mounted to a single mounting hole disposed on the specific duct-side mounting piece, by means of a shared mounting member.

With the fourth feature of the present invention, the pair of resonator-side mounting pieces are mounted to the single mounting hole disposed on the specific duct-side mounting piece by means of the shared mounting member. This ensures reducing the number of mounting members. Additionally, sharing the single mounting hole on the specific duct-side mounting piece allows the mutual interval between the adjacent resonators to be further reduced.

According to a fifth feature of the present invention, in addition to the second feature, a pair of the resonator-side mounting pieces of the resonator are disposed along an imaginary plane passing through the turning center of the resonator when mounting the resonator to the duct.

With the fifth feature of the present invention, the pair of resonator-side mounting pieces are disposed along the imaginary plane passing through the turning center of the resonator when mounting the resonator to the duct. Accordingly, in a case where the resonators disposed symmetrically at the pair of right and left ducts are mounted, the resonator can be shared, thereby ensuring the reduction in the number of components.

According to a sixth feature of the present invention, in addition to the third or fourth feature, the plurality of resonators are formed to have outer shapes thereof different from each other, the resonators being coupled to the duct via respective cylindrical coupling members whose one end portions are respectively fitted to the openings of the duct, and inner diameters of a plurality of the coupling members are set to be different from each other.

With the sixth feature of the present invention, the plurality of resonators having the outer shapes thereof different from each other are coupled to the duct via the respective cylindrical coupling members whose one end portions are fitted to the openings of the duct. The inner diameters of the coupling members are set to be different from each other. With the use of the plurality of resonators with different outer shapes, differentiating the inner diameters of the coupling members allows an adjustment of resonance performance.

According to a seventh feature of the present invention, in addition to the sixth feature, the duct is disposed to open an upstream end of the duct to a front of a vehicle, the duct guiding external air to an internal combustion engine mounted on the vehicle, and the inner diameter of the coupling member disposed on an upstream side of the duct, among the plurality of coupling members, is set smaller than the inner diameter of the coupling member disposed on a downstream side of the duct.

With the seventh feature of the present invention, the duct is disposed to open the upstream end thereof to the front of the vehicle. The inner diameter of the coupling member on the upstream side of the duct is set smaller than the inner diameter of the coupling member on the downstream side of the duct. This ensures suppressing the entrance of dust and water, suctioned to the upstream end portion of the duct together with air, to the resonator on the upstream side.

According to an eighth feature of the present invention, in addition to the third or fourth feature, outer surfaces of one end portions on the duct side of the coupling members are formed into taper shapes whose diameters become smaller as heading for tip end sides of the one end portions.

With the eighth feature of the present invention, the outer surfaces of the one end portions of the coupling members fitted to the openings of the duct are formed into the taper shapes. This eases the fitting of the coupling members to the openings of the duct, thereby further easing the attachment work.

The above and other objects, characteristics and advantages of the present invention will be clear from detailed descriptions of the preferred embodiment which will be provided below while referring to the attached drawings.

DESCRIPTION OF THE PREFERRED EMBODIMENT

The following describes an embodiment of the present invention referring to the accompanying FIG. 1 to FIG. 4. The following description defines the front, rear, right, left, up, and down as directions viewed from an occupant riding on a two-wheeled motor vehicle.

Figure 1:
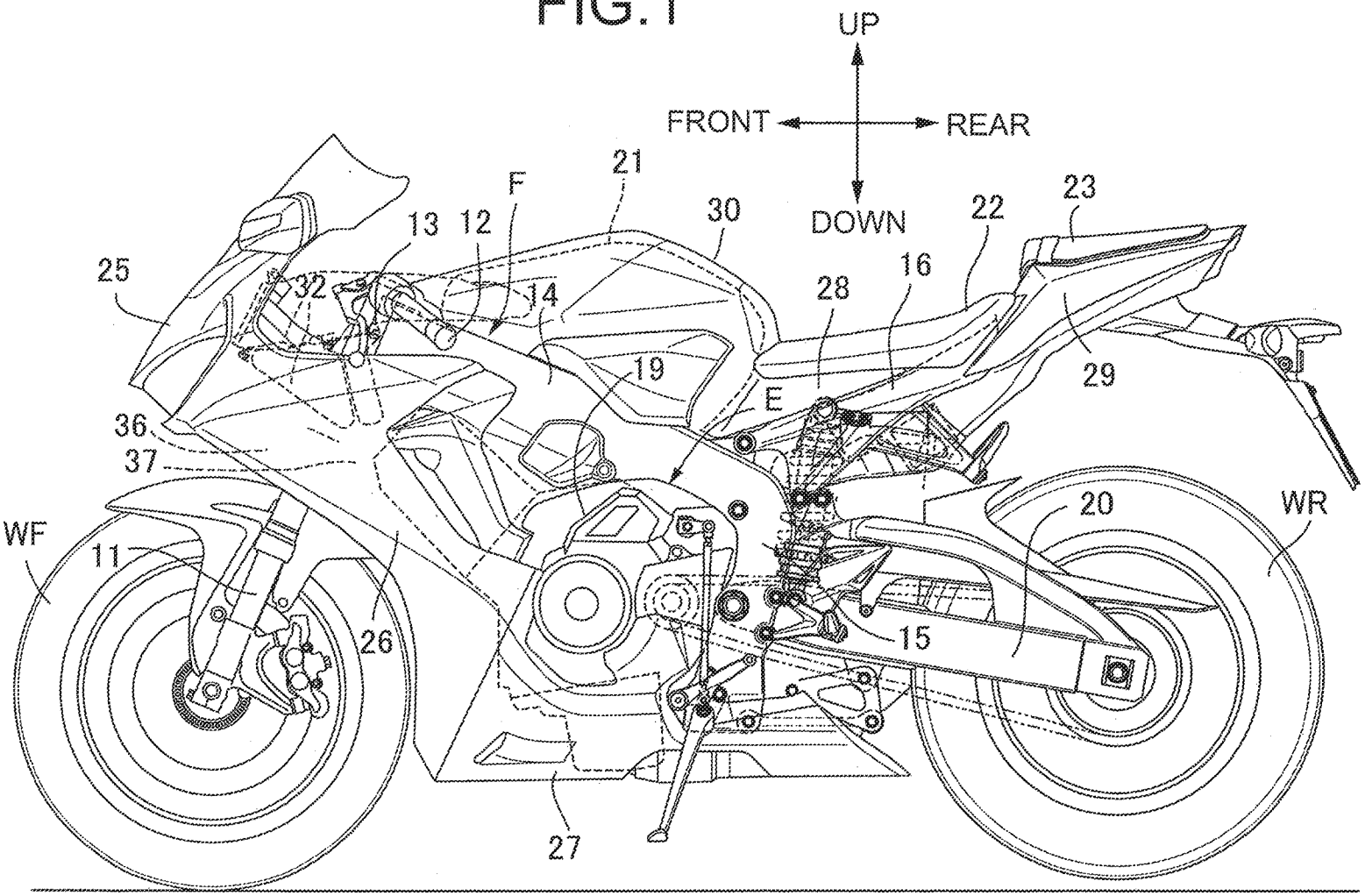
FIG. 1 is a left side view of a two-wheeled motor vehicle.

First, in FIG. 1, a body frame F of the two-wheeled motor vehicle includes a head pipe 13, a pair of right and left main frames 14, a pair of right and left pivot frames 15, a pair of right and left seat rails 16, and the like. The head pipe 13 steerably supports front forks 11 that pivotally supports a front wheel WF, and a steering handle 12 coupled to the front forks 11. The main frames 14 extend from the head pipe 13 downward to the rear. The pivot frames 15 are integrally connected with rear portions of the main frames 14 and extend downward. The seat rails 16 extend from the rear portions of the main frames 14 upward to the rear.

An engine body 19 of an internal combustion engine E disposed below the main frames 14 is supported to the body frame F. Additionally, front end portions of swing arms 20 are supported to the pivot frames 15 so as to be able to swing up and down, rear end portions of the swing arms 20 pivotally supporting a rear wheel WR driven by a power provided by the internal combustion engine E.

A fuel tank 21 is mounted to the main frames 14 above the internal combustion engine E. A riding front seat 22 and a riding rear seat 23 are supported by the seat rails 16. The riding front seat 22 is disposed at the rear of the fuel tank 21. The riding rear seat 23 is disposed further rearward of the riding front seat 22.

The head pipe 13 at a front end portion of the body frame F is covered with a front cowl 25 from forward. The front cowl 25 is supported by the body frame F so as to be disposed immediately above the front wheel WF. A pair of right and left center cowls 26 are connected with both right and left sides of the front cowl 25. The center cowls 26 cover a front portion of the body frame F and a part of the internal combustion engine E from lateral sides. A pair of right and left lower cowls 27 are connected with respective rear-side lower portions of the center cowls 26. The lower cowls 27 cover a lower portion of the internal combustion engine E from lateral sides and a lower side and are mutually joined together. Further, a pair of right and left side covers 28 are disposed between the fuel tank 21 and the riding front seat 22. The side covers 28 cover a rear-side lower portion of the fuel tank 21 from opposite sides. A rear cowl 29 covers a part of the seat rails 16 disposed below the riding rear seat 23. The fuel tank 21 is covered with a tank cover 30.

Figure 2:
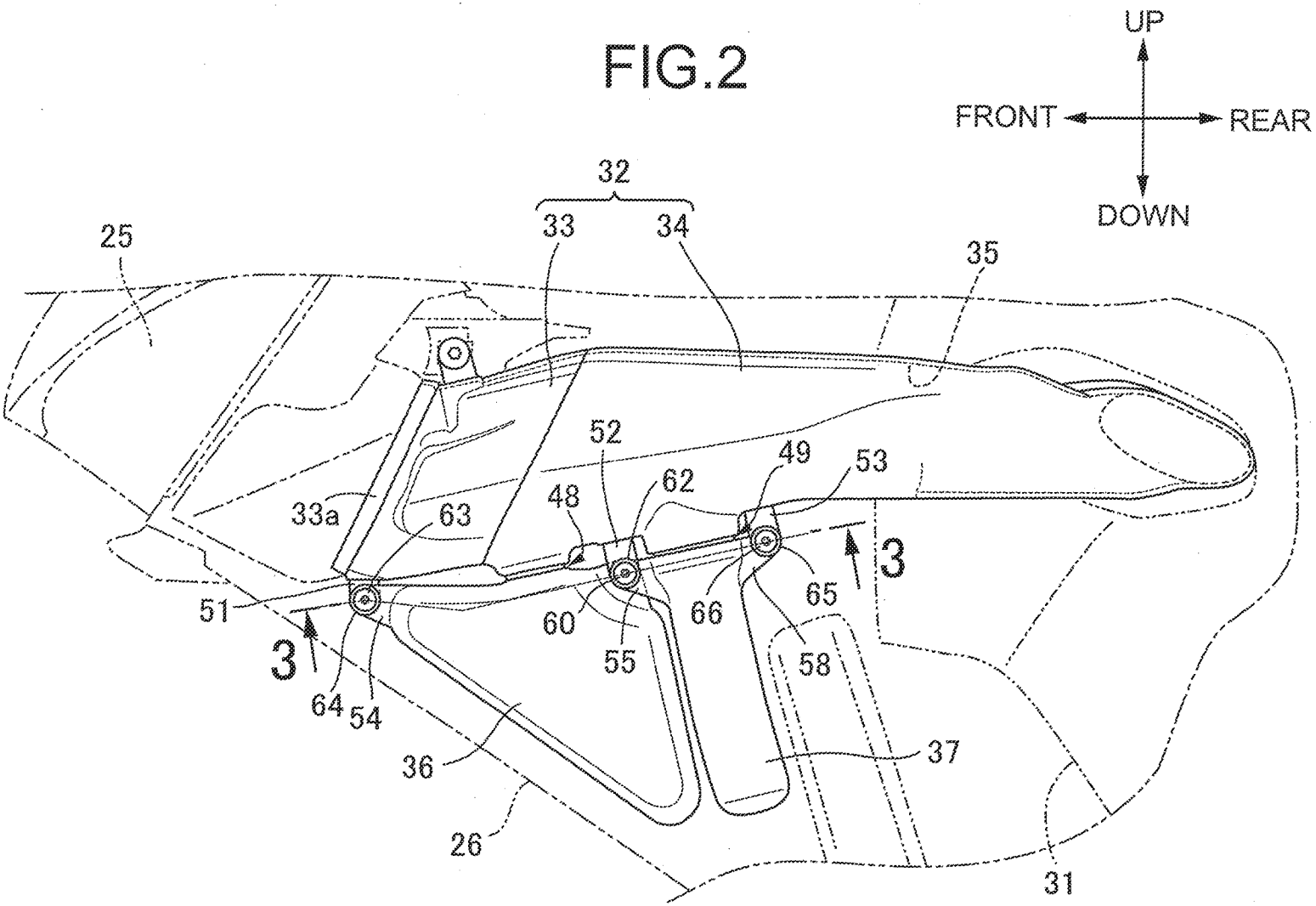
FIG. 2 is an enlarged view of a main part in FIG. 1 in a state of omitting a center cowl.

With reference to FIG. 2 together, an air cleaner 31 for the internal combustion engine E is disposed above the engine body 19. Ducts 32 to guide external air to the air cleaner 31 are disposed on both right and left sides of the head pipe 13 in the body frame F so that an upstream end portion 33*a* of the duct 32 is opened forward along a vehicle front-rear direction. These ducts 32 are coupled commonly to the air cleaner 31.

The duct 32 is formed of an upstream-side duct member 33 and a downstream-side duct member 34 combined with each other. The upstream-side duct member 33 has the front end portion, more specifically the upstream end portion 33*a*, opened toward a front of the vehicle and is mounted to the center cowl 26. The downstream-side duct member 34 couples this upstream-side duct member 33 and the air cleaner 31.

A plurality of resonators, first and second resonators 36 and 37 in this embodiment, are formed separately from the ducts 32 and are mounted to the ducts 32 in parallel in the vehicle front-rear direction. The ducts 32 and the first and the second resonators 36 and 37 are disposed symmetrically.

Figure 3:
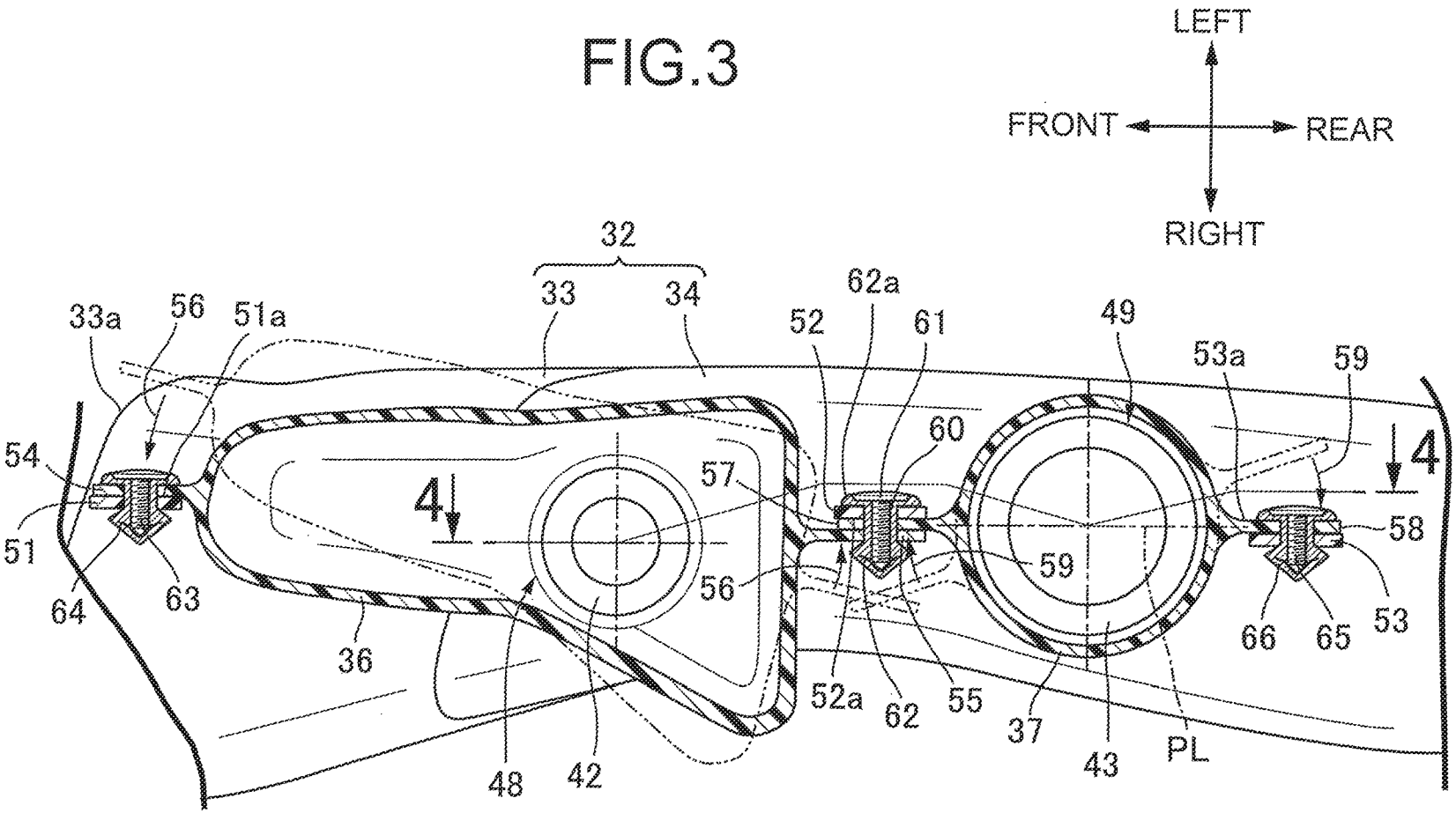
FIG. 3 is a sectional view taken along a line 3-3 in FIG. 2.
Figure 4:
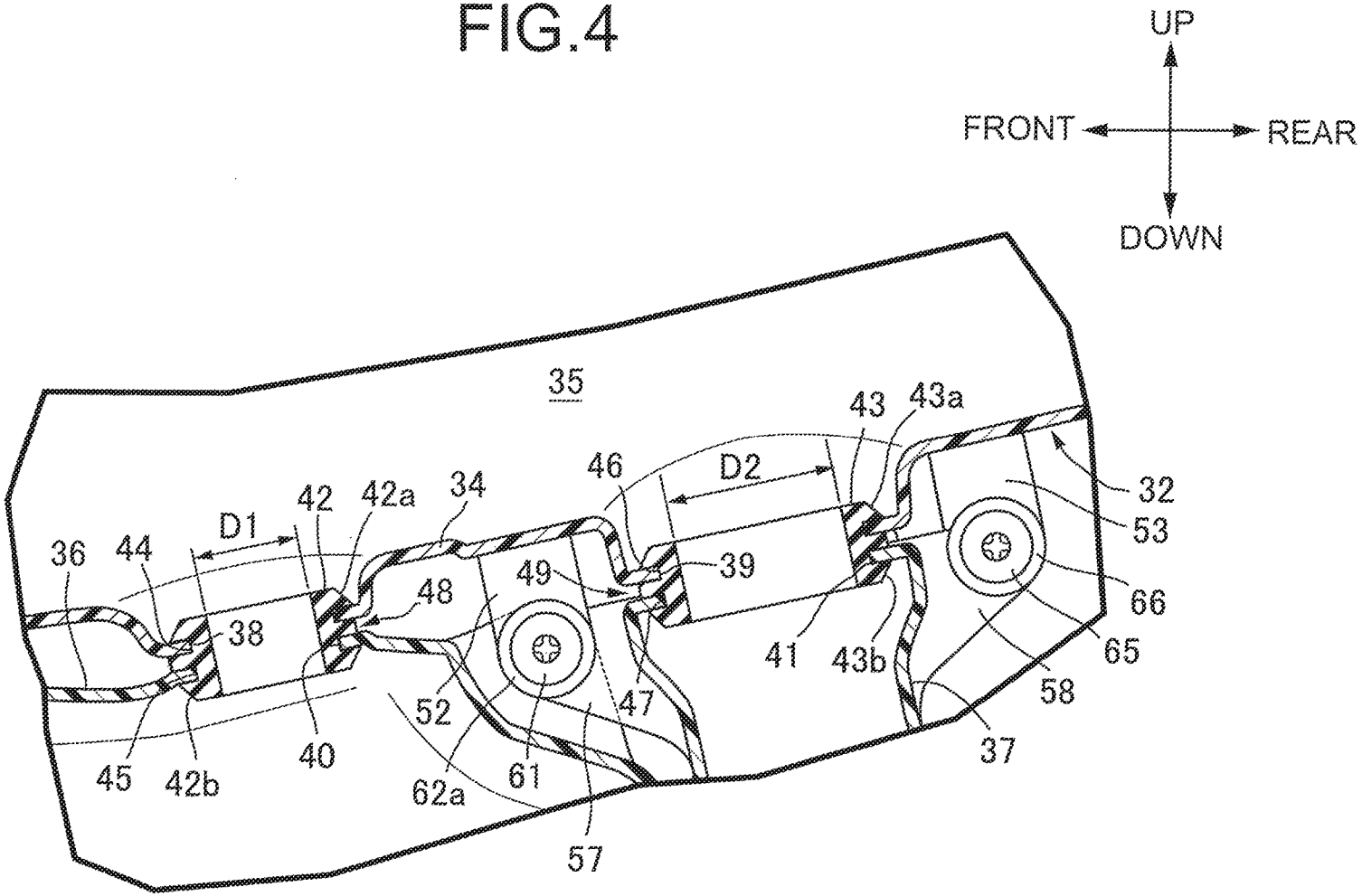
FIG. 4 is a sectional view taken along a line 4-4 in FIG. 3.

With reference to FIG. 3 and FIG. 4 together, a first opening 38 and a second opening 39 are disposed at a lower portion of the downstream-side duct member 34 of the duct 32. The first opening 38 communicates with a flow passage 35 for air formed in the duct 32 and corresponds to a first resonator 36. The second opening 39 communicates with the flow passage 35 and corresponds to a second resonator 37. Both the first and the second openings 38 and 39 are formed into a circular shape.

On the other hand, at an upper portion of the first resonator 36, a first communication port 40 coupled to the first opening 38 is disposed. At an upper portion of the second resonator 37, a second communication port 41 coupled to the second opening 39 is disposed. Both the first and the second communication ports 40 and 41 are formed into a circular shape.

The first communication port 40 provided at the first resonator 36 is coupled to the first opening 38 via a first coupling member 42 made of an elastic material and formed into a cylindrical shape. The second communication port 41 provided at the second resonator 37 is coupled to the second opening 39 via a second coupling member 43 made of an elastic material and formed into a cylindrical shape.

One end portions of the first and the second coupling members 42 and 43 are fitted to the first and the second openings 38 and 39 in the duct 32. Outer surfaces 42*a* and 43*a* of one end portions of the first and the second coupling members 42 and 43 on the duct 32 side are formed into taper shapes whose diameters become smaller as heading for the tip end sides. Furthermore, the other end portion of the first coupling member 42 is fitted to the first communication port 40 in the first resonator 36. The other end portion of the second coupling member 43 is fitted to the second communication port 41 in the second resonator 37. An outer surface 42*b* of the other end portion of the first coupling member 42 on the first resonator 36 side and an outer surface 43*b* of the other end portion of the second coupling member 43 on the second resonator 37 side are formed into taper shapes whose diameters become smaller as heading for the tip end sides.

Annular grooves 44 and 45 are formed on an outer surface of an intermediate portion of the first coupling member 42. A peripheral edge portion of the first opening 38 in the downstream-side duct member 34 of the duct 32 is engaged with the annular groove 44, and a peripheral edge portion of the first communication port 40 in the first resonator 36 is engaged with the annular groove 45. Annular grooves 46 and 47 are formed on an outer surface at an intermediate portion of the second coupling member 43. A peripheral edge portion of the second opening 39 in the downstream-side duct member 34 is engaged with the annular groove 46, and a peripheral edge portion of the second communication port 41 in the second resonator 37 is engaged with the annular groove 47.

More specifically, a coupling portion 48 of the first resonator 36 to the duct 32 is formed by fitting and locking opposite end portions of the first coupling member 42 to the first opening 38 and the first communication port 40. A coupling portion 49 of the second resonator 37 to the duct 32 is formed by fitting and locking opposite end portions of the second coupling member 43 to the second opening 39 and the second communication port 41. These coupling portions 48 and 49 can cause the first and the second resonators 36 and 37 to turn so as to mount the first and the second resonators 36 and 37 to the duct 32. This allows the first resonator 36 to turn so as to screw, into the first opening 38, the one end portion of the first coupling member 42 that has been fitted and locked to the first resonator 36. Additionally, this allows the second resonator 37 to turn so as to screw, into the second opening 39, the one end portion of the second coupling member 43 that has been fitted and locked to the second resonator 37.

To mount the first resonator 36 to the duct 32, a plurality of tabular-shaped duct-side mounting pieces, a pair of first and second duct-side mounting pieces 51 and 52 in this embodiment, are disposed at a lower portion of the downstream-side duct member 34 in the duct 32, the duct-side mounting pieces being disposed at intervals in a peripheral direction of the coupling portion 48. The first resonator 36 includes tabular-shaped first and second resonator-side mounting pieces 54 and 55 mounted to the duct-side mounting pieces 51 and 52.

Mounting surfaces 51*a* and 52*a* are formed on the first and the second duct-side mounting pieces 51 and 52 so as to be opposed to a turning direction 56 of the first resonator 36 when mounting the first resonator 36 to the duct 32, the first and the second resonator-side mounting pieces 54 and 55 being abutted against and mounted to the mounting surfaces 51*a* and 52*a*.

Moreover, the first and the second duct-side mounting pieces 51 and 52 are disposed at the downstream-side duct member 34 so as to be respectively positioned on the opposite sides of the coupling portion 48 on a projection view (the view corresponding to FIG. 3) to a plane perpendicular to a turning center of the first resonator 36 when the first resonator 36 is mounted to the duct 32, namely, a centerline of the coupling portion 48.

The second resonator 37 is disposed parallel to the first resonator 36 while adjacent to the first resonator 36 on the downstream side thereof in a flowing direction in the flow passage 35 inside the duct 32. To mount the second resonator 37 to the duct 32, the plurality of tabular-shaped duct-side mounting pieces disposed at intervals in the peripheral direction of the coupling portion 49 are provided on the lower portion of the downstream-side duct member 34. In this embodiment, the second resonator 37 shares, with the first resonator 36, the second duct-side mounting piece 52 disposed between the first and the second resonators 36 and 37, as the specific duct-side mounting piece. Meanwhile, the second duct-side mounting piece 52 and the third duct-side mounting piece 53 are provided, corresponding to the second resonator 37, on the lower portion of the downstream-side duct member 34. The second and the third duct-side mounting pieces 52 and 53 are disposed at the downstream-side duct member 34 so as to be respectively positioned on the opposite sides of the coupling portion 49 on the projection view (the view corresponding to FIG. 3) to the plane perpendicular to a turning center of the second resonator 37 when the second resonator 37 is mounted to the duct 32, namely, a centerline of the coupling portion 49.

The second resonator 37 includes a tabular-shaped third resonator-side mounting piece 57 mounted to the second duct-side mounting piece 52 and a tabular-shaped fourth resonator-side mounting piece 58 mounted to the third duct-side mounting piece 53.

Mounting surfaces 52*a* and 53*a* are formed on the second and the third duct-side mounting pieces 52 and 53 so as to be opposed to a turning direction 59 of the second resonator 37 when mounting the second resonator 37 to the duct 32, the third and the fourth resonator-side mounting pieces 57 and 58 being abutted against and mounted to the mounting surfaces 52*a* and 53*a*

Meanwhile, among the first and the second resonator-side mounting pieces 54 and 55 of the first resonator 36 and the third and the fourth resonator-side mounting pieces 57 and 58 of the second resonator 37, the second and the third resonator-side mounting pieces 55 and 57 disposed closer to each other are mounted in common to the second duct-side mounting piece 52 which is the specific duct-side mounting piece disposed between the first and the second resonators 36 and 37.

Moreover, the second duct-side mounting piece 52 includes a single mounting hole 60. The mutually overlapped second and third resonator-side mounting pieces 55 and 57 are mounted to the mounting hole 60 by means of shared mounting members. This embodiment provides a pin 61 and a grommet 62 as the mounting members. The grommet 62 includes a flange 62*a* that abuts against and engages with the second duct-side mounting piece 52 from a side opposite to the mounting surface 52*a*. The grommet 62 is inserted into the second duct-side mounting piece 52, the third resonator-side mounting piece 57, and the second resonator-side mounting piece 55. The insertion of the pin 61 expands a diameter of the grommet 62.

The first resonator-side mounting piece 54 is mounted to the first duct-side mounting piece 51 with a pin 63 and a grommet 64. The fourth resonator-side mounting piece 58 is mounted to the third duct-side mounting piece 53 with a pin 65 and a grommet 66.

The first and the second resonators 36 and 37 are formed so as to have outer shapes thereof different from each other. While the first resonator 36 has a non-circular outer shape, the second resonator 37 has a bottomed cylindrical outer shape coaxially with the second coupling member 43 and a circular shaped cross-section. Moreover, the third and the fourth resonator-side mounting pieces 57 and 58 disposed at the second resonator 37 are disposed along an imaginary plane PL passing through the turning center of the second resonator 37 when the second resonator 37 is mounted to the duct 32. The second and the third duct-side mounting pieces 52 and 53 disposed at the downstream-side duct member 34 of the duct 32 corresponding to the second resonator 37 are arranged at the positions displaced from the imaginary plane PL.

Moreover, an inner diameter D1 of the first coupling member 42 coupling the first resonator 36 to the duct 32 and an inner diameter D2 of the second coupling member 43 coupling the second resonator 37 to the duct 32 are set to be different from each other. Among the first and the second coupling members 42 and 43, the first coupling member 42 is disposed to be positioned on the upstream side of the duct 32. More specifically, the inner diameter D1 of the first coupling member 42 coupling the first resonator 36 to the duct 32 is set smaller than the inner diameter D2 of the second coupling member 43 coupling the second resonator 37 to the duct 32.

The following describes an operation of this embodiment. The duct 32 is provided with the first to the third duct-side mounting pieces 51, 52, and 53 in order to mount the first and the second resonators 36 and 37 to the duct 32. The first and the second resonators 36 and 37 include the first and the second communication ports 40 and 41 coupled to the first and the second openings 38 and 39 of the duct 32, and are formed separately from the duct 32. The first and the second resonator-side mounting pieces 54 and 55 are disposed at the first resonator 36, corresponding to the first and the second duct-side mounting pieces 51 and 52. The third and the fourth resonator-side mounting pieces 57 and 58 are disposed at the second resonator 37, corresponding to the second and the third duct-side mounting pieces 52 and 53. The coupling portions 48 and 49 of the first and the second resonators 36 and 37 to the duct 32 are configured to ensure turning the first and the second resonators 36 and 37 when the first and the second resonators 36 and 37 are mounted to the duct 32. A plurality of the duct-side mounting pieces 51 to 53 are disposed with intervals in the peripheral direction of the coupling portions 48 and 49, and are formed with the mounting surfaces 51*a*, 52*a*, and 53*a*. The mounting surfaces 51*a*, 52*a*, and 53*a* are formed to be opposed to the turning directions 56 and 59 of the first and the second resonators 36 and 37 when mounting the first and the second resonators 36 and 37 to the duct 32. The first to the fourth resonator-side mounting pieces 54, 55, 57, and 58 are abutted against and mounted to the mounting surfaces 51*a*, 52*a*, and 53*a*. Accordingly, when the first and the second resonators 36 and 37 are screwed into the duct 32 while being turned so as to be mounted to the duct 32, the first and the second resonators 36 and 37 are easily turned in a range where the first to the fourth resonator-side mounting pieces 54, 55; 57, 58 do not interfere with the first to the third duct-side mounting pieces 51 to 53, ensuring enhancing attachablily.

Furthermore, the first and the second duct-side mounting pieces 51 and 52 for the first resonator 36 and the second and the third duct-side mounting pieces 52 and 53 for the second resonator 37 are disposed on the duct 32 so as to be respectively positioned on the opposite sides of the coupling portions 48 and 49 on the projection view to the plane perpendicular to the turning centers of the first and the second resonators 36 and 37 when the first and the second resonators 36 and 37 are mounted to the duct 32. This allows the first and the second resonators 36 and 37 to be turned at an angle close to 180 degrees when the first and the second resonators 36 and 37 are mounted, thereby ensuring further improvement of attachablily at the maximum turning range.

Furthermore, the first and the second resonators 36 and 37 are mounted parallel to the duct 32. The first and the second resonators 36 and 37 adjacently paired in the parallel direction include respectively one pair of the resonator-side mounting pieces 54 and 55 and one pair of the resonator-side mounting pieces 57 and 58. The second and the third resonator-side mounting pieces 55 and 57 disposed closer to each other, among the resonator-side mounting pieces 54, 55; 57, 58, are mounted in common to the second duct-side mounting piece 52 disposed between the adjacently paired first and second resonators 36 and 37, among the first to the third duct-side mounting pieces 51 to 53 of the duct 32. This reduces the number of duct-side mounting pieces 51 to 53 that are disposed at the duct 32, ensuring reduction in an interval between the first and the second resonators 36 and 37 adjacent to each other.

Furthermore, the second and the third resonator-side mounting pieces 55 and 57 corresponding to the second duct-side mounting piece 52, are mounted to the single mounting hole 60 disposed on the second duct-side mounting piece 52 with the pin 61 and the grommet 62 as the shared mounting members. This ensures reducing the number of mounting members. Additionally, sharing the single mounting hole 60 of the second duct-side mounting piece 52 allows the mutual interval between the adjacent first and second resonators 36 and 37 to be smaller.

Further, the third and the fourth resonator-side mounting pieces 57 and 58 disposed at the second resonator 37 are disposed along the imaginary plane PL passing through the turning center of the second resonator 37 when mounting the second resonator 37 to the duct 32. Accordingly, when the second resonators 37 disposed symmetrically at the pair of right and left ducts 32 are mounted, the second resonator 37 can be shared between the right and the left, thereby ensuring the reduction in the number of components.

Moreover, the first and the second resonators 36 and 37 are formed so as to have the outer shapes thereof different from each other. The first and the second resonators 36 and 37 are coupled to the duct 32 via the respective cylindrical first and second coupling members 42 and 43 whose one end portions are fitted to the first and the second openings 38 and 39 of the duct 32. The inner diameters D1 and D2 of the first and the second coupling members 42 and 43 are set to be different from each other. With the use of the first and the second resonators 36 and 37 with different outer shapes, differentiating the inner diameters D1 and D2 of the first and the second coupling members 42 and 43 allows an adjustment of resonance performance.

Moreover, the duct 32 is disposed so as to open the upstream end portion 33*a* thereof to the front of the vehicle and guide the external air to the internal combustion engine E mounted to the vehicle. Among the first and the second coupling members 42 and 43, the inner diameter D1 of the first coupling member 42 disposed on the upstream side of the duct 32 is set smaller than the inner diameter D2 of the second coupling member 43 disposed on the downstream side of the duct 32. This ensures suppressing the entrance of dust and water, suctioned to the upstream end portion of the duct 32 together with air, to the first resonator 36 disposed on the upstream side.

Further, the outer surfaces 42*a* and 43*a* of one end portions on the duct 32 side of the first and the second coupling members 42 and 43 are formed into the taper shapes whose diameters become smaller as heading for the tip end sides. This eases the fitting of the first and the second coupling members 42 and 43 to the first and the second openings 38 and 39 of the duct 32, thereby easing the attachment work.

An embodiment of the present invention is explained above, but the present invention is not limited to the above-mentioned embodiment and may be modified in a variety of ways as long as the modifications do not depart from the gist of the present invention.

What is claimed is:

1. A structure for mounting resonators to a duct, in which the duct that forms a flow passage for air is provided with openings and a plurality of duct-side mounting pieces, and the resonators are provided with a plurality of resonator-side mounting pieces that are mounted to the duct-side mounting pieces, the resonators including communication ports coupled to the openings and being formed separately from the duct, wherein coupling portions of the duct and the resonators are configured to ensure turning the resonators when the resonators are mounted to the duct, and the plurality of duct-side mounting pieces are disposed with intervals in a peripheral direction of the coupling portions, and the plurality of duct-side mounting pieces include mounting surfaces, the mounting surfaces being formed to be opposed to turning directions of the resonators when mounting the resonators to the duct, the resonator-side mounting pieces being abutted against and mounted to the mounting surfaces.

2. The structure for mounting the resonators to the duct according to claim 1, wherein a pair of the duct-side mounting pieces are disposed on the duct so as to be respectively positioned on opposite sides of each of the coupling portions on a projection view to a plane perpendicular to turning centers of the resonators when the resonators are mounted to the duct.

3. The structure for mounting the resonators to the duct according to claim 2, wherein a plurality of the resonators are mounted parallel to the duct, the resonators adjacently paired in a parallel direction each including one pair of the resonator-side mounting pieces, a pair of the resonator-side mounting pieces disposed closer to each other, among the resonator-side mounting pieces, being mounted in common to a specific duct-side mounting piece that is disposed between the resonators adjacently paired among the plurality of duct-side mounting pieces of the duct.

4. The structure for mounting the resonators to the duct according to claim 3, wherein the pair of resonator-side mounting pieces corresponding to the specific duct-side mounting piece are mounted to a single mounting hole disposed on the specific duct-side mounting piece, by means of a shared mounting member.

5. The structure for mounting the resonators to the duct according to claim 2, wherein a pair of the resonator-side mounting pieces of the resonator are disposed along an imaginary plane passing through the turning center of the resonator when mounting the resonator to the duct.

6. The structure for mounting the resonators to the duct according to claim 3, wherein the plurality of resonators are formed to have outer shapes thereof different from each other, the resonators being coupled to the duct via respective cylindrical coupling members whose one end portions are respectively fitted to the openings of the duct, and inner diameters of a plurality of the coupling members are set to be different from each other.

7. The structure for mounting the resonators to the duct according to claim 6, wherein the duct is disposed to open an upstream end of the duct to a front of a vehicle, the duct guiding external air to an internal combustion engine mounted on the vehicle, and the inner diameter of the coupling member disposed on an upstream side of the duct, among the plurality of coupling members, is set smaller than the inner diameter of the coupling member disposed on a downstream side of the duct.

8. The structure for mounting the resonators to the duct according to claim 3, wherein outer surfaces of one end portions on the duct side of the coupling members are formed into taper shapes whose diameters become smaller as heading for tip end sides of the one end portions.

9. The structure for mounting the resonators to the duct according to claim 4, wherein the plurality of resonators are formed to have outer shapes thereof different from each other, the resonators being coupled to the duct via respective cylindrical coupling members whose one end portions are respectively fitted to the openings of the duct, and inner diameters of a plurality of the coupling members are set to be different from each other.

10. The structure for mounting the resonators to the duct according to claim 4, wherein outer surfaces of one end portions on the duct side of the coupling members are formed into taper shapes whose diameters become smaller as heading for tip end sides of the one end portions.

* * * * *